US006129532A

United States Patent [19]

Kato et al.

[11] Patent Number: 6,129,532

[45] Date of Patent: Oct. 10, 2000

[54] $CO_2$ COMPRESSOR

[75] Inventors: Hiroyasu Kato, Kariya; Masafumi Nakashima, Anjo; Takeshi Sakai, Chiryu; Kazuhide Uchida, Nishio, all of Japan

[73] Assignee: DENSO Corporation, Kariya, Japan

[21] Appl. No.: 09/256,350

[22] Filed: Feb. 24, 1999

[30] Foreign Application Priority Data

Feb. 24, 1998 [JP] Japan ..... 10-042386

[51] Int. Cl.[7] ..... F04C 18/00

[52] U.S. Cl. ..... 418/55.6; 418/55.2; 418/55; 418/87; 418/97; 417/269; 62/228.5; 62/498; 92/12.2

[58] Field of Search ..... 418/55.6, 55.2, 418/87, 97, 55; 62/498, 228.5; 417/269; 92/12.2

[56] References Cited

U.S. PATENT DOCUMENTS

| | | | |
|---|---|---|---|
| 4,666,381 | 5/1987 | Butterworth | 418/55 |
| 4,997,350 | 3/1991 | Tamura et al. | 418/55.6 |
| 5,277,563 | 1/1994 | Wen-Jen et al. | 418/55.5 |
| 5,694,784 | 12/1997 | Frey et al. | 62/228.5 |
| 5,894,782 | 4/2000 | Nessen et al. | 92/12.2 |
| 5,921,756 | 7/1999 | Matsuda et al. | 417/269 |
| 5,951,272 | 9/1999 | Fukuhara et al. | 418/55.4 |
| 6,053,715 | 4/2000 | Hirano et al. | 418/55.6 |

FOREIGN PATENT DOCUMENTS

| | | |
|---|---|---|
| 59-119992 | 8/1984 | Japan . |
| 408312546 | 11/1996 | Japan . |
| 11094379 | 9/1997 | Japan . |

*Primary Examiner*—Thomas Denion
*Assistant Examiner*—Thai-Ba Trieu
*Attorney, Agent, or Firm*—Pillsbury Madison & Sutro LLP

[57] ABSTRACT

A $CO_2$ compressor is disclosed for forcing and moving a lubricant under discharge pressure. If the oil path is reduced in size or a pressure reducing part is inserted to handle the large differential pressure caused between the discharge pressure and the intake pressure, the oil path would become liable to be easily clogged by foreign matter. In view of this, an intermittent oil supply mechanism is formed in the oil path using the sliding contact portion between a fixed member of the compressor body and a movable member. Thus, the substantial lubrication time period is shortened and the amount of oil supplied is limited.

7 Claims, 3 Drawing Sheets

$CO_2$ COMPRESSOR

BACKGROUND OF THE INVENTION

1. Field of the Invention

The present invention relates to a $CO_2$ compressor for compressing the $CO_2$ (carbon dioxide) refrigerant used in an air-conditioning system or, more particularly, to a lubricant supply unit for the $CO_2$ compressor.

2. Description of the Related Art

In an air-conditioning system using a fluoride such as HFC134 as a refrigerant, as has been widely used in the prior art, a lubricant supply unit is employed in which a lubricant such as a refrigerating machine oil mixed in advance with the refrigerant is separated from the refrigerant compressed and temporarily held in the discharge chamber of the refrigerant compressor, and the lubricant thus separated is forced by the differential pressure between the discharge pressure and the intake pressure of the compressor itself, or the differential pressure between the discharge pressure or the intake pressure and the pressure intermediate of the two pressures, without using a lubricant pump or the like requiring driving power, thereby supplying the lubricant to the sliding parts or the like of the refrigerant compressor requiring lubrication for forcibly lubricating such parts.

In the lubricant supply unit described above, if the differential pressure between the discharge pressure and the intake pressure used for forcing the lubricant increases with the rotational speed of the compressor, the flow rate of the lubricant sometimes increases more than necessary. Therefore, as described in Japanese Unexamined UM Publication (Kokai) No. 59-119992, for example, a pressure reducing part such as a thin restrictor or a porous material is inserted in an oil path, or the oil path of the lubricant is narrowed and lengthened, to increase the resistance thereof, thereby to suppress the flow rate of the lubricant.

In an air-conditioning system using $CO_2$ as a refrigerant, the differential pressure between intake pressure and discharge pressure is about five times higher than that for an air-conditioning system using an ordinary refrigerant such as HFC134. For forcible lubrication by forcing the lubricant under the differential pressure between the discharge pressure and the intake pressure of the refrigerant compressor using $CO_2$ as a refrigerant, it is necessary to reduce the flow rate of the lubricant much more than when an ordinary refrigerant is used. Thus, a restrictor, or a like pressure reducing part, arranged in the oil path is required to be very thin and long.

Fabrication of a thin, long pressure reducing part for use in the lubricant path requires labor for machining, which leads to a high cost. Not only that, foreign matter such as metal dust generated at the time of machining and sometimes remaining attached to the parts constituting a refrigeration cycle, or foreign matter or a highly viscous lump produced when a condensing material mixed, though rarely, in the refrigerant or the lubricant is condensed, can clog the pressure reducing parts such as a thin restrictor formed in the lubricant supply unit and prevents stable lubrication. This can reduce the performance and reliability of the compressor and hence of the air-conditioning system.

SUMMARY OF THE INVENTION

The object of the present invention is to cope with the above-mentioned problems of the conventional lubricant supply unit used for the $CO_2$ compressor and to obviate the problems with novel means whereby the oil path of the lubricant supply unit of the $CO_2$ compressor is prevented from being clogged with foreign matter thereby to assure the stable supply of a proper amount of lubricant while at the same time reducing the fabrication cost of the parts associated with the lubricant supply unit of the $CO_2$ compressor.

According to the present invention, as a means for solving the problems described above, there is provided a $CO_2$ compressor described in each of the appended claims.

In a $CO_2$ compressor according to this invention, the lubricant stored in an oil tank is forced by the differential pressure between the outlet-side pressure and the inlet-side pressure and supplied under pressure to the parts requiring lubrication. Therefore, the lubricant supply unit which consumes power such as a lubricant pump is not required. Also, in spite of the very large differential pressure between the discharge pressure and the intake pressure which is a problem unique to a refrigerant compressor of an air-conditioning system using the $CO_2$ refrigerant, the lubricant is supplied to the parts requiring lubrication by adjusting the lubricant flow rate without using any pressure reducing parts for reducing the size of the lubricant flow path. Therefore, as compared with the case of using a pressure reducing part such as a very thin restrictor to meet the large differential pressure, the likelihood of the pressure reducing parts being clogged with foreign matter is eliminated, and a stable, reliable lubricant supply unit can be realized. Further, the absence of the process for machining the pressure reducing parts decreases the manufacturing cost.

More specifically, the $CO_2$ compressor according to the present invention comprises what is called an intermittent lubrication mechanism arranged at least in a part of the oil path for supplying oil intermittently. Therefore, the amount (flow rate) of the lubricant supply can be freely set and changed by adjusting the lubrication time length with the intermittent lubrication mechanism without any pressure reducing parts in the oil path. As a result, there is no problem of the oil path being clogged up with foreign matter which otherwise might be caused in the pressure-reducing parts used in the oil path. Thus, a stable and reliable lubricant supply unit can be realized. At the same time, the eliminated need of machining the pressure-reducing parts can reduce the manufacturing cost.

In the case where the $CO_2$ compressor according to the present invention is constituted of a scroll-type $CO_2$ compressor, the intermittent lubrication mechanism arranged in the oil path can be configured of an end plate of the movable scroll of the scroll-type compressor and a fixed member opposed thereto. Since the oil path is automatically opened and closed by the orbiting of the end plate, it is not necessary to provide the intermittent lubrication mechanism with a special valve and driving means thereof or the like. In this case, the intermittent lubrication mechanism can be constructed between the back side of the end plate of the movable scroll and the surface of the fixed member opposed thereto or between the front side of the end plate of the movable scroll and the surface of the fixed member opposed thereto.

In the case where the $CO_2$ compressor according to this invention is constituted of a piston-type compressor especially having a reciprocating piston, on the other hand, the intermittent lubrication mechanism arranged in the oil path can be constructed between the piston and the cylinder bore into which the piston is inserted slidably. In this case, the opening of the oil path to the cylinder bore is opened or closed by the reciprocating motion of the piston. The oil path is automatically opened or closed by the piston and therefore provision of a special valve means is not required for the intermittent lubrication mechanism. Also, in the case where a piston ring is provided for the piston, the intermittent lubrication mechanism can be constructed between the piston ring and the cylinder bore into which the piston is slidably inserted. In this case, the whole structure can be simplified by constructing a part of the oil path with a piston ring groove.

DESCRIPTION OF THE REFERRED EMBODIMENTS

Figure 1:
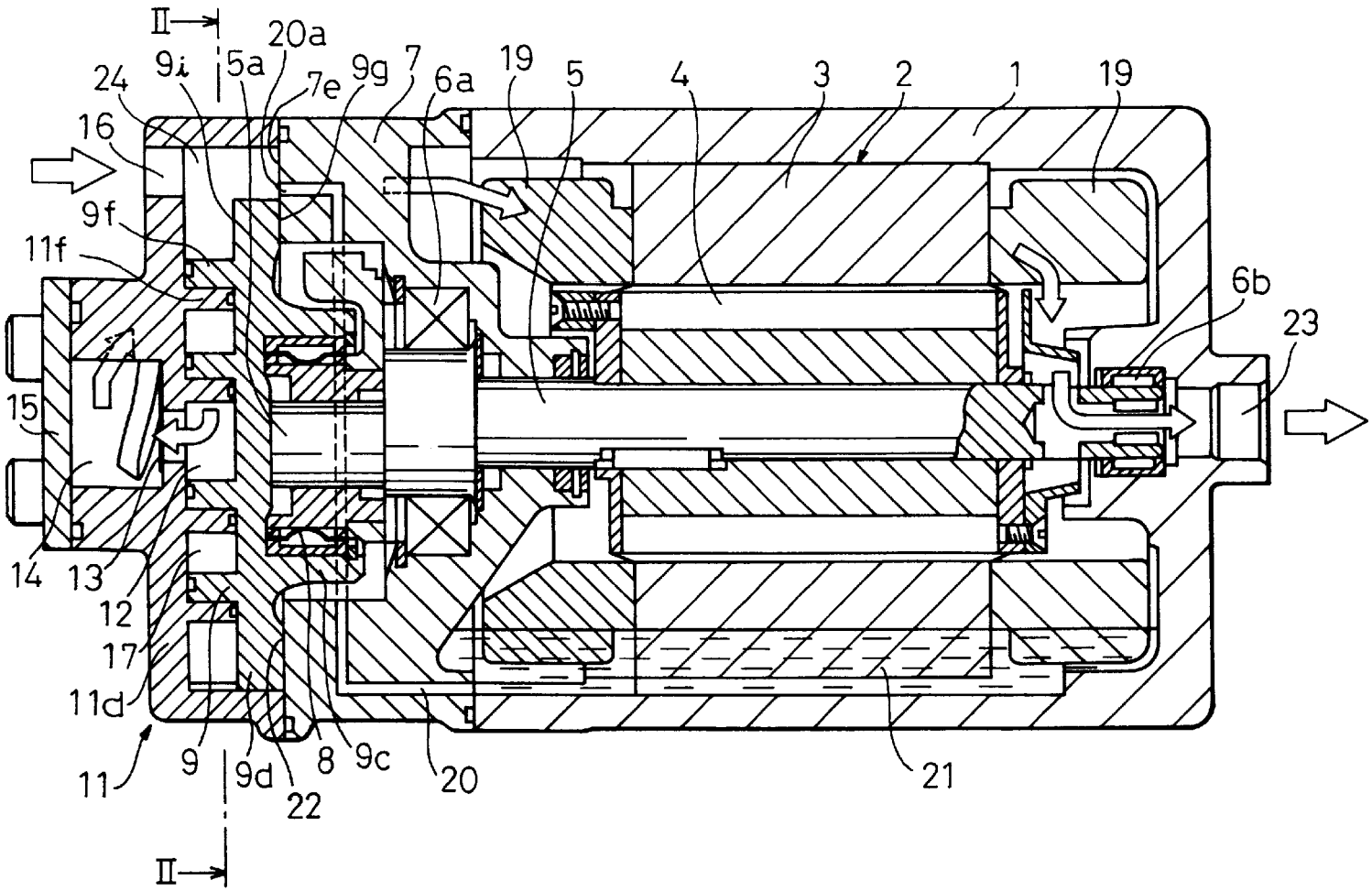
FIG. 1 is a longitudinal front sectional view showing a first embodiment of the invention.

FIG. 1 illustrates an electric motor driven $CO_2$ compressor of scroll type constituting a $CO_2$ compressor according to a first embodiment of the invention. A major right portion of the internal space of a main housing 1 is occupied by a motor 2 making up a drive unit. Specifically, a field core 3 is fixed along the inner surface of the housing 1, and an armature 4 having a plurality of permanent magnets therein is integrally supported by a shaft 5, thus constituting an AC motor 2. The armature 4 is axially supported by front and rear bearings 6*a*, 6*b* for supporting the shaft 5 and is adapted to rotate freely with respect to the field core 3.

An end of the shaft 5 extends into a compressor housing 7 integrated, by being screwed, to the housing 1 and thereby forms a crank 5*a* eccentric with respect to the axial center of the shaft 5. The crank 5*a* rotatably supports a boss 9*c* at the center of a movable scroll 9 through a bearing 8. Though not shown, an end plate 9*d* of the movable scroll 9 is provided with an anti-rotation mechanism for preventing rotation, while allowing orbiting, of the movable scroll 9.

A sliding unit 22 is formed in sliding contact with the back surface 9*g* of the end plate 9*d* of the movable scroll and the left end surface 7*e* in FIG. 1 of the compressor housing 7 as thrust receiving surfaces. In this way, a thrust supporting mechanism is configured in which the fluid is compressed in the working chamber formed between volute blades 9*f*, 11*f* of two scrolls 9, 11, and the resulting compressive reaction force generated thereby pushes the movable scroll 9 rightward in the drawing while at the same time axially supporting the movable scroll 9. Thus, while the compressive reaction force in the working chamber acts on the thrust receiving surfaces 9*g*, 7*e* of the sliding unit 22, a thrust is generated to push back the movable scroll 9 toward the fixed scroll 11.

The central working chamber 12 formed between the volute blades 9*f*, 11*f* of the two scrolls 9, 11 combined in mesh with each other is adapted to communicate with an outlet chamber 14 formed as a space outside the end plate 11*d* of the fixed scroll 11 when the discharge valve 13 constituting a check valve of constant-pressure open type opens. The outlet chamber 14, which is closed by a lid 15, communicates with the interior of the main housing 1 through a path not shown, and further, through the gaps of the field core 3 and the coil 19 of the motor 2, communicates with an outlet port 23. The outlet port 23 is connected to the refrigeration cycle of the air-conditioning system using $CO_2$ as a refrigerant.

According to the first embodiment, an intake port 16 is arranged at the upper part of the end plate 11*d* of the fixed scroll 11. When the outermost one of a plurality of crescent working chambers 17 formed between the volute blades 9*f*, 11*f* nearer to the outer periphery from the center of the two scrolls 9, 11 opens toward the outer periphery, the particular working chamber 17 communicates with the intake port 16 so that the $CO_2$ to be compressed is allowed into the intake port 16.

The electric motor driven $CO_2$ compressor of a scroll type according to this embodiment has the configuration described above. When the coil 19 of the motor 2 is supplied with AC power, therefore, the armature 4 and the shaft 5 integrated with the armature 4 are rotationally driven, and like the ordinary scroll-type compressor, the movable scroll 9 is rotationally driven by the crank 5*a* with an eccentric shaft. In view of the fact that the movable scroll 9 is allowed to orbit but not to rotate by the anti-rotation mechanism, not shown, however, the crescent working chambers 17 formed between the volute blades 9*f*, 11*f* of the two scrolls 9, 11 allow the $CO_2$ gas therein from the intake port 16 when the outer peripheral portion of the working chambers 17 is open. After the same outer peripheral portion closes, the $CO_2$ gas gradually moves radially inward while being reduced in volume. Thus, the $CO_2$ gas is compressed into a high pressure. The compressed $CO_2$ gas is discharged into the central working chamber 12 when the crescent working chambers 17 open toward the central working chamber 12. Further, when the pressure of the working chamber 12 exceeds the opening pressure of the outlet valve 13, the outlet valve 13 opens so that the compressed $CO_2$ is sent into the outlet chamber 14.

The compressed $CO_2$ gas in the outlet chamber 14 flows into the main housing 1 and toward the outlet port 23 through a path not shown as indicated by arrow. In the meantime, the lubricant like the refrigerating machine oil mixed with $CO_2$ as a refrigerant is separated and stays in the oil tank 21 on the bottom of the housing 1. In the process, the lubricant, of course, lubricates the internal sliding parts such as the bearings of the motor 2. The pressure of the compressed $CO_2$, i.e. the discharge pressure is exerted on the lubricant held in the main housing 1 and hence held in the oil tank 21 formed on the bottom thereof. The compressed $CO_2$ gas flowing through the gaps of the internal component parts of the motor 2 in the housing 1 also acts to cool the parts including the coil 19 of the motor 2, etc.

The feature of the first embodiment lies in an oil path 20 establishes a communication between the compressor housing 7. The oil path 20 communicates between the oil tank 21 formed in the lower part of the main housing 1 for storing the lubricant separated from the $CO_2$ refrigerant and the outlet port 20*a* opening at the position operated by the orbiting motion of the end plate 9*d* of the movable scroll, on the end surface 7*e* of the housing 1 forming the sliding unit 22 in sliding contact with the back surface 9*g* of the end plate 9*d* of the movable scroll 9.

Figure 2:
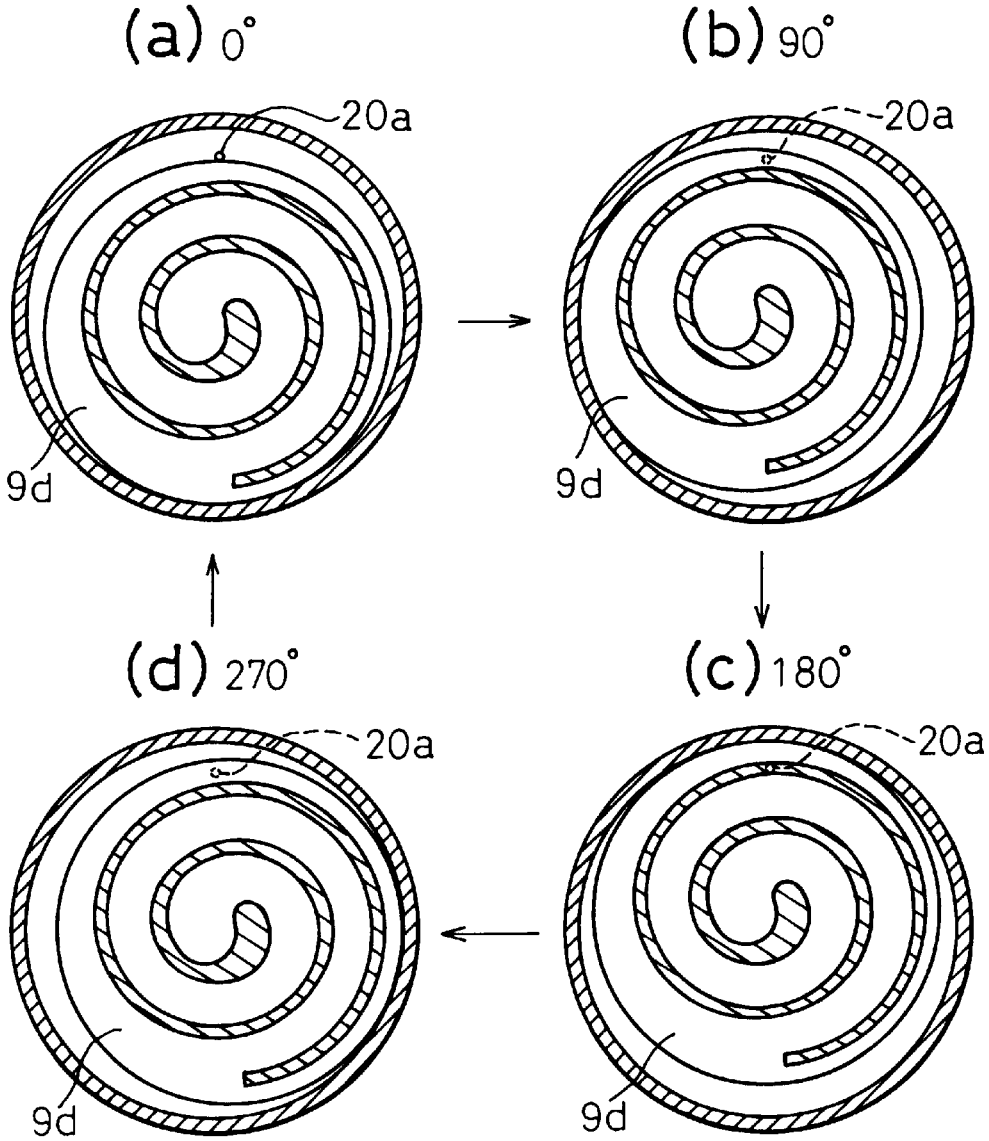
FIG. 2 includes four cross side sectional views (a) to (d) taken at II—II in FIG. 1 showing the movable scroll being orbited by 90° each time.

FIG. 2 is a side view taken in line II—II in FIG. 1, and the four diagrams (a), (b), (c) and (d) thereof show the state of the movable scroll 9 moved in increments of 90° from the state (a). In (a) of FIG. 1, the outlet port 20*a* of the oil path is not covered with the end plate 9*d* of the movable scroll 9 but opens toward the intake chamber 24. Therefore, the internal pressure of the oil tank 21, i.e. the differential pressure between the discharge pressure of the $CO_2$ compressor and the intake pressure of the intake chamber 24 causes the lubricant in the oil tank 21 to be moved under pressure to the discharge port 20*a* formed in the sliding unit 22 through the oil path 20. As a result, the lubricant is supplied to and sufficiently lubricates the sliding contacting portions of the volute blades 9*f*, 11*f* of the two scrolls 9, 11 forming the working chambers 17 and the working chamber 12.

In the state shown in (b) to (d) of FIG. 2 where the movable scroll 9 is orbited and the discharge port 20*a* is covered by the back surface 9*g* of the end plate 9*d*, the flow of the lubricant passing through the oil path 20 is shut off. In the process, the back surface 9*g* of the end plate 9*d* is pressed against the end surface 7*e* of the compressor housing 7 by the compressive reaction force exerted in the working chambers 12, 17. The discharge port 20*a* thus is closed up positively. As a consequence, the lubricant is supplied intermittently from the outlet port 20*a* and the time length of supplying the lubricant is shortened substantially. This in turn makes it possible to increase the amount of lubricant supplied through the outlet port 20*a* during a given time when the outlet port 20*a* is open. Therefore, the pressure-reducing parts such as the restrictor for limiting the flow rate of the lubricant is not required in the oil path 20. As a result, the problems of foreign matter clogging the pressure reducing parts and the additional cost of machining are obviated. Thus, the lubricant can be supplied stably and positively, while at the same time reducing the cost and improving the performance and reliability of the compressor.

In the above-mentioned case, the substantial time length of supplying the lubricant and the amount of lubricant supplied can be changed by changing the opening position of the outlet port 20*a* of the oil path 20 on the end surface 7*e* of the compressor housing 7. The amount of lubricant supplied can thus be easily changed according to the type of the compressor. The same function is obtained by opening a communication hole of a retainer or the like in registry with the outlet port 20*a*, which retainer or the like is inserted as a sliding member into the end surface 7*e* of the housing 7 forming the sliding unit 22.

In the first embodiment shown, the intermittent oil supply mechanism having the outlet port 20*a* is configured on the sliding unit 22 between the back surface 9*g* of the end plate 9*d* of the movable scroll 9 and the end surface 7*e* of the compressor housing 7. As an alternative, the intermittent oil supply mechanism can be formed between the other surface, i.e. the front surface 9*i* of the end plate 9*d* of the movable scroll 9 and a protruded portion, not shown, formed to expand from the end plate 11*d* of the fixed scroll 11 in opposed relation to the front surface 9*i*. Also, the feature of the first embodiment is not limited to the electric motor driven scroll-type compressor enclosed in its entirety as shown but is applicable also to the scroll-type open $CO_2$ compressor as well.

Figure 3:
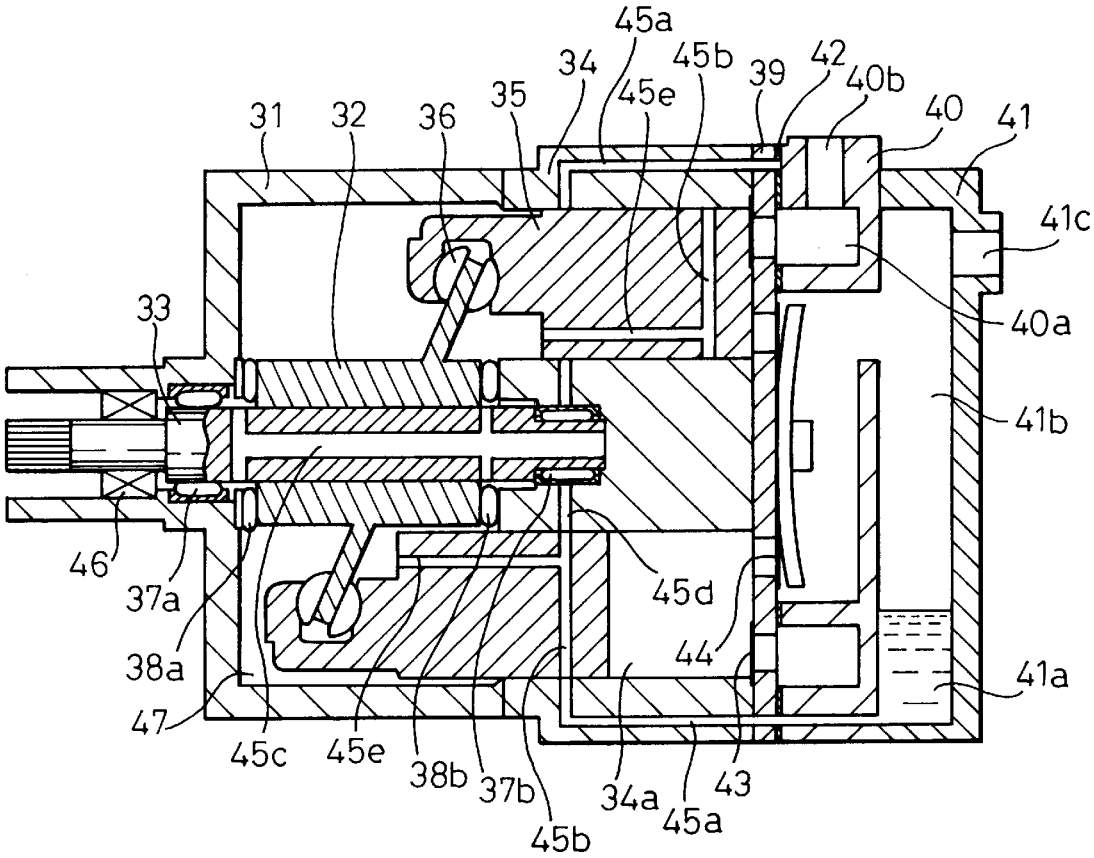
FIG. 3 is a longitudinal front sectional view showing a second embodiment of the invention.

FIG. 3 is a longitudinal front sectional view of a $CO_2$ compressor of swash plate type configured as open type according to a second embodiment of the invention. In FIG. 3, numeral 31 designates a front housing, numeral 32 a swash plate mounted on a shaft 33, numeral 34 a cylinder block, numeral 34*a* a plurality of cylinder bores formed in the cylinder block 34 in parallel to the shaft 33, numeral 35 a piston slidably inserted into a cylinder bore 34*a*, numeral 36 a shoe arranged at the portion of the piston 35 where it is slidably coupled to the swash plate 32, numerals 37*a*, 37*b* radial bearings for axially supporting the shaft 33, numerals 38*a*, 38*b* thrust bearings, and numeral 39 a valve plate.

Numeral 40 designates a rear housing mounted at an end of the cylinder block 34 with the valve plate 39 therebetween. The rear housing 40 has an intake chamber 40*a* formed therein. An intake port 40*b* for receiving the $CO_2$ gas to be compressed is arranged in the intake chamber 40*a*. Further, an oil separator 41 is mounted on the back of the rear housing 40. These component parts are fastened to each other integrally by a through bolt or the like not shown. The oil separator 41 has a space formed therein for separating the lubricant from the $CO_2$ refrigerant under pressure. The lower part of the oil separator 41 constitutes an oil tank 41*a* and the upper part thereof constitutes an outlet chamber 41*b*. An outlet port 41*c* communicating with the refrigeration cycle of the air-conditioning system, not shown, is formed in the upper part of the oil separator 41. Numeral 42 designates a gasket, numeral 43 an intake valve, and numeral 44 an outlet valve.

The feature of the second embodiment lies in that an oil path 45*a* open to the wall surface of the cylinder bore 34*a* is formed through the oil tank 41*a* of the oil separator 41, the rear housing 40, the gasket 42 and the cylinder block 34 in that order. The piston 35 is formed with an oil path 45*b* in radial direction in such a position as to communicate with the oil path 45*a* when the piston 35 is at about the bottom dead center. Further, the shaft 33 is formed with an oil path 45*c* communicating with the parts requiring lubrication including radial bearings 37*a*, 37*b*, thrust bearings 38*a*, 38*b*, and a shaft seal 46. When the oil paths 45*a*, 45*b* described above communicate with each other, the oil path 45*c* comes to communicate with these oil paths through an oil path 45*d* formed in the cylinder block 34 thereby to receive the lubricant.

Numeral 45*e* designates an oil path branching from the oil path 45*b* for supplying the lubricant to the sliding contact surfaces of the swash plate 32 and the shoe 36. The oil path 45*a* formed in the upper part of the cylinder block 34 also communicates with the lower oil path 45*a* to receive the lubricant from the oil tank 41*a* through an oil path such as an oil groove not shown formed along the surface on which the gasket 42 of the valve plate 39 is mounted.

As long as the swash plate chamber 47 containing the swash plate 32 remains to communicate with the intake chamber 40*a* in the rear housing 40 by a path not shown, the swash plate chamber 47 is kept under an intake pressure during the operation. In the absence of such a path, however, the swash plate chamber 47 naturally assumes a pressure intermediate between the discharge pressure of the outlet chamber 41*b* and the intake pressure of the intake chamber 40*a*. Therefore, the pressure of the swash plate chamber 47 is lower than the discharge pressure. Consequently, in the example shown in FIG. 3, the lubricant stored in the oil tank 41*a* is supplied under pressure to the parts requiring lubrication, due to the differential pressure described above, only when any one of the pistons 35 reaches the neighborhood of the bottom dead center and the oil paths 45*a*, 45*d* of the cylinder block 34 communicate with the oil path 45*b* of the piston 35. As a result, the lubricant is supplied intermittently, and the amount of the lubricant supplied is properly adjusted without any pressure reducing parts such as a restrictor in the oil paths, thereby attaining substantially the same effect as the first embodiment.

Though not shown, in a $CO_2$ compressor with a piston ring mounted on the piston thereof as a modification of the second embodiment, an intermittent oil supply mechanism can be configured of an opening of the oil path formed in the cylinder bore, the cylindrical surface of the piston and the sliding surface of the piston ring by using the piston ring groove as a part of the oil path. Also, as in the first and second embodiments, an electric motor driven enclosed compressor of a piston type can be configured.

What is claimed is:

1. A $CO_2$ compressor for compressing the $CO_2$ gas used in the refrigeration cycle of an air-conditioning system using $CO_2$ as a refrigerant, comprising:

a housing for covering at least the main parts;

a fixed member integrated with said housing and remaining stationary;

a movable member slidable relatively with said fixed member for forming at least one working chamber as a space with said fixed member for compressing the refrigerant, said movable member being driven for expanding or compressing said working chamber;

separation means formed for separating the lubricant mixed with the refrigerant from the refrigerant discharged;

a lubricant tank connected with said separation means for storing the separated lubricant under pressure;

at least one oil path extending from said oil tank toward said parts requiring lubrication for sending said lubricant forced by the pressure of the refrigerant on the discharge side from said oil tank to said parts; and an intermittent oil supply mechanism in which a part of said oil path open to the surface of said fixed member is opened or closed by said movable member thereby to allow the lubricant to be passed intermittently under pressure to said parts requiring lubrication from said oil tank.

2. A $CO_2$ compressor according to claim 1, constituting a scroll-type $CO_2$ compressor, wherein said intermittent oil supply mechanism is configured between an end plate of a movable scroll constituting said movable member and a part of said housing constituting said fixed member in opposed relation to said end plate, and wherein the opening of said oil path opened on the surface of said part of said housing is opened or closed by said end plate orbiting.

3. A $CO_2$ compressor according to claim 2, wherein said surface of said part of said housing is in an opposed relation to the back side of said end plate of said movable scroll for constituting said intermittent oil supply mechanism.

4. A $CO_2$ compressor according to claim 2, wherein said surface of said part of said housing is in opposed relation to the front side of said end plate of said movable scroll for constituting said intermittent oil supply mechanism.

5. A $CO_2$ compressor according to claim 1, constituting a piston-type $CO_2$ compressor having at least a piston adapted for reciprocating motion, wherein said intermittent oil supply mechanism is configured between said piston constituting said movable member and a cylinder bore constituting said fixed member into which said piston is slidably inserted, and said oil path is opened and closed by the reciprocating action of said piston.

6. A $CO_2$ compressor according to claim 1, constituting a piston-type $CO_2$ compressor having at least a piston adapted for reciprocating motion, wherein said intermittent oil supply mechanism is configured between a piston ring constituting said movable member mounted on said piston and a cylinder bore constituting said fixed member into which said piston is slidably inserted, and said oil path is opened and closed by the reciprocating action of said piston.

7. A $CO_2$ compressor according to claim 6, wherein a part of said oil path is configured of a piston ring groove formed in said piston and on which said piston ring is mounted.

* * * * *